US005349904A

United States Patent [19]

Ganter

[11] Patent Number: 5,349,904

[45] Date of Patent: Sep. 27, 1994

[54] NON-STOP PILE-CHANGE DEVICE IN A DELIVERY OF A PRINTING PRESS

[75] Inventor: Udo Ganter, Friedberg, Fed. Rep. of Germany

[73] Assignee: Heidelberger Druckmaschinen AG, Heidelberg, Fed. Rep. of Germany

[21] Appl. No.: 88,154

[22] Filed: Jul. 6, 1993

[30] Foreign Application Priority Data

Jul. 3, 1992 [DE] Fed. Rep. of Germany ..... 4221928

[51] Int. Cl.[5] ..... B41F 13/56

[52] U.S. Cl. ..... 101/227; 101/240; 414/790.8

[58] Field of Search ..... 101/226, 227, 238, 240, 101/236, 237, 239, 241; 414/788.1, 788.9, 789.5, 789.9, 790.2, 790.4, 790.8; 270/95

[56] References Cited

U.S. PATENT DOCUMENTS

| | | | |
|---|---|---|---|
| Re. 23,641 | 4/1953 | Andrew | 270/95 |
| 3,651,961 | 3/1972 | Hayes | 414/790.5 |
| 3,994,221 | 11/1976 | Littleton | 101/227 |
| 4,061,086 | 12/1977 | Preuss | 101/240 |
| 4,624,452 | 11/1986 | Pulsakamp | 270/95 |
| 4,749,179 | 6/1988 | Hornung | 270/95 |
| 4,878,658 | 11/1989 | Pollich . | |
| 4,983,096 | 1/1991 | Budewein | 270/95 |
| 5,020,786 | 6/1991 | Kimura et al. | 414/789.5 |
| 5,103,725 | 4/1992 | Sugimoto et al. | 101/227 |
| 5,263,415 | 11/1993 | Pollich | 101/240 |

FOREIGN PATENT DOCUMENTS

| | | |
|---|---|---|
| 1231721 | 1/1967 | Fed. Rep. of Germany . |
| 3220798 | 1/1984 | Fed. Rep. of Germany . |
| 8430170 | 6/1988 | Fed. Rep. of Germany . |
| 4116510 | 12/1991 | Fed. Rep. of Germany . |
| 784000 | 10/1957 | United Kingdom . |
| 1376853 | 12/1974 | United Kingdom . |
| 1493291 | 11/1977 | United Kingdom . |
| 2211828 | 11/1987 | United Kingdom . |

*Primary Examiner*—Eugene H. Eickholt

*Attorney, Agent, or Firm*—Herbert L. Lerner; Laurence A. Greenberg

[57] ABSTRACT

Non-stop pile-changing device in a delivery of a printing press includes an auxiliary pile support insertable between two sheets in a sheet-conveying direction for temporarily receiving thereon oncoming sheets in an auxiliary pile, a device for exchanging a main pile of sheets and an old main pile support whereon the main pile has been deposited for a new main pile support, and a device for depositing the auxiliary pile on the new main pile support, the auxiliary pile support being relatively thin in comparison with the thickness of the main pile support, and remaining underneath the auxiliary pile and forming a base for the auxiliary pile as it is being deposited on the new main pile support.

13 Claims, 2 Drawing Sheets

NON-STOP PILE-CHANGE DEVICE IN A DELIVERY OF A PRINTING PRESS

The invention relates to a non-stop pile change device in a delivery of a printing press wherein an auxiliary pile carrier is insertable between two oncoming sheets in a sheet-conveying direction for temporarily receiving the oncoming sheets on an auxiliary pile thereof, and means are provided for depositing the auxiliary pile on a carrier for a new main pile which has been exchanged for a previously present main pile.

Various auxiliary pile supports formed of plates, rods, rakes, rows of cords or tapes, areas of fabric or the like which can be inserted manually or automatically and which permit a time-saving pile change while the printing press is running, have become known heretofore. The pile change requires the heightened attention of the pressman because operating errors may readily cause damage to the sheets. With thicker printing materials or stock, the time available for the pile change is limited because the maximally permissible height of the auxiliary pile is rapidly reached.

German Patent 12 31 721 discloses an auxiliary pile support for a mechanically movable device for pile changing formed of a roll-up lattice-type table which is made up of rods movably connected to one another and which, in an idle position thereof, is disposed forward of the sheet pile in the delivery, in a rolled-up condition so that, as viewed in sheet-conveying direction, it may be unrolled between two sheets into a working position extending parallel to the pile surface, for the purpose of changing piles while the printing press is running. In this flat or planar position above the sheet pile, the lattice-type table temporarily receives the arriving sheets so that an auxiliary pile is formed while the main pile may be removed and replaced by a new main pile support. Upon completion of the pile-changing process, the auxiliary pile is deposited on the main pile support, and the lattice-type table is pulled back into the rolled-up idle position thereof.

Mechanically moved auxiliary pile supports in this or a modified construction could not operate properly, heretofore, with high-speed machines, especially when processing thin types of paper. A great problem is presented by, namely, the insertion and withdrawal of the auxiliary pile supports and the damage to the sheets caused thereby. It is, of course, true that proposals have been made, heretofore, for reducing friction between the auxiliary pile support and the lowermost sheet of the auxiliary pile, for example, to provide the auxiliary pile support with roller elements or a friction-minimizing coating on the surface thereof, however, no breakthrough could be achieved thereby for high-speed machines and for processing thin printing materials or stock, so that the use thereof has remained limited to printing presses for cardboard or the like.

It is accordingly an object of the invention to provide a non-stop pile-change device in a delivery of a printing press which avoids sheet damage and permits the pile change to be performed manually, if necessary or desirable, and especially mechanically.

With the foregoing and other objects in view, there is provided, in accordance with the invention, a non-stop pile-changing device in a delivery of a printing press, comprising an auxiliary pile support insertable between two sheets in a sheet-conveying direction for temporarily receiving thereon oncoming sheets in an auxiliary pile, means for exchanging a main pile of sheets and an old main pile support whereon the main pile has been deposited for a new main pile support, and means for depositing the auxiliary pile on the new main pile support, the auxiliary pile support being relatively thin in comparison with the thickness of the main pile support, and remaining underneath the auxiliary pile and forming a base for the auxiliary pile as it is being deposited on the new main pile support.

This construction is based upon the idea that, when depositing the auxiliary pile on the new main pile support, no friction is permitted to occur between the lowermost sheet of the auxiliary pile and parts of the non-stop pile-change device. This leads to the basic conception of the invention to leave the auxiliary pile support under the auxiliary pile so that, on the one hand, it causes sheet damage in the lower region of the auxiliary pile, however, on the other hand, it assumes a specific protective function for the lower region of the main pile. Independence of the properties of the printing material or stack and, essentially, also of the press speed is thereby achieved, so that, even for thin paper and high machine speeds, a non-stop pile change may be accomplished in less time than is required in the state of the art. Thus, each pile change requires a new auxiliary pile support because the auxiliary pile support of the preceding pile change remains underneath the pile and is consequently lost. Accordingly, the auxiliary pile support is formed of an inexpensive material such as paper, thin cardboard, plastics or the like, for example.

In accordance with this general approach to a solution, the auxiliary pile support may be inserted manually and stabilized either by means of conventional auxiliary pile supports such as, for example, a plate or the like or by holding and clamping means for receiving the auxiliary pile.

In accordance with a preferred construction for implementing the basic concept of the invention, however, is effected mechanically in a non-stop manner. For this purpose, transport means which are movable parallel to the pile surface and seize the auxiliary pile support are provided to feed or advance the auxiliary pile support. Transport means suitable therefor are, for example, clamping tapes revolving parallel to the sheet sides, the clamping tapes being disposed in pairs and clamping the respective margin or edge of the auxiliary pile support therebetween. Further suitable transport means include at least one pneumatic cylinder which can be telescopically extended parallel to the sheet pile surface, the extensible end thereof having a sheet gripper secured thereto and dragging the auxiliary pile support during the extension. If the material of the auxiliary pile support is of sufficiently stiff quality, the slide-in device may also be formed of a pair of rollers arranged in the delivery immediately before the sheet pile and between which the auxiliary pile support is guided, the pair of rollers functioning like a film-transporting device in a camera.

A further construction of the invention dispenses with means which are insertable and extensible for the purpose of stabilizing the auxiliary pile support; in place thereof, self-stabilization of the auxiliary pile support by means of tensional forces acting in horizontal direction may be provided. For this purpose, the auxiliary pile support is inserted so that its lateral margins are disposed between the jaws of a clamping device clamping the auxiliary pile support therebetween after it has been inserted; if necessary or desirable, these clamping jaws may perform an additional outwardly directed clamping movement so that the auxiliary pile support has adequate tension for receiving an auxiliary pile.

Advantageously, the auxiliary pile support is unwound as a web from a web reel, a cross cutter being provided to separate or sever an auxiliary pile support of sufficient length from the web of material of the auxiliary pile support. The auxiliary support web may be inserted, even at high press speeds, in synchronism with the velocity of the arriving sheets by guiding the auxiliary support web between the web reel and the cross cutter through a festooning unit which stores a length of the web of the auxiliary pile support necessary for an auxiliary pile support and which releases the stored web length without moving the web reel, when the auxiliary pile support is inserted. In so doing, the mass inertia of the web reel is eliminated. Such a festooning unit is advantageously formed of a spool-like device which receives a pre-determined web length of the auxiliary support material, when turned in one direction, and releases the web length, when turned in the opposite direction. With a somewhat simplified construction, auxiliary pile supports may be disposed in a paper-advancing or feeding unit in changeable cassettes, the auxiliary supports being fed individually. The auxiliary pile support may be matched to the format by changing the auxiliary pile support material, for example, the web reel or the cassette. The material of the auxiliary pile support may also be adapted or matched, with respect to the width thereof, to the maximum format width so that for smaller formats the width thereof could be matched by trimming the lateral margins of the auxiliary pile support with slitters, if necessary.

More specifically, in accordance with another feature of the invention, the auxiliary pile support is formed of a material selected from the group consisting of paper, cardboard and plastic material.

In accordance with a further feature of the invention, releasable clamping jaws are included which are mounted in the delivery of the printing press for clamping side margins of the inserted auxiliary pile support as the oncoming sheets are deposited in an auxiliary pile thereon.

In accordance with an added feature of the invention, transport means are provided for seizing the auxiliary pile support and feeding it between the two sheets parallel to a surface of the pile.

In accordance with an additional feature of the invention, the transport means include a feeding unit comprising pairwise arranged clamping tapes laterally revolvable parallel to sides of the sheets for clamping respective margins of the auxiliary pile support therebetween.

In accordance with an alternative feature of the invention, the transport means include a feeding unit comprising at least one pneumatic cylinder disposed parallel to the sheet-pile surface and extensible telescopically, an extensible end of the pneumatically extensible cylinder having a sheet gripper secured thereto.

In accordance with another alternative feature of the invention, the transport means include a feeding unit comprising at least one roller pair having gear rims at least at the ends of one roller of the roller pair.

In accordance with yet a further feature of the invention, the device includes a web reel having a web wound thereon, means for unwinding the web from the web reel so as to form the auxiliary pile support therefrom, and a cross cutter adjacent the unwinding means for severing a web length corresponding to the auxiliary pile support from the web.

In accordance with yet an added feature of the invention, a festooning unit is included into which the web length corresponding to the auxiliary pile support, prior to being severed from the web wound on the web reel, is guidable for storage therein, the stored web length being releasable for inserting it as the auxiliary pile support between the two sheets, while the web reel remains stationary.

In accordance with yet an additional feature of the invention, the festooning unit is adjustable so that the stored web length corresponds with the length of a respective format.

In accordance with another feature of the invention, the festooning unit comprises a spool-type device turnable in one direction for receiving thereon the web length of pre-determined dimension, the spool-type device being turnable in the opposite direction for releasing the web length while the web reel remains stationary.

In accordance with a further feature of the invention, a cassette having a plurality of the auxiliary pile supports stored therein is included, the auxiliary pile supports having dimensions matching the respective format of the oncoming sheets.

In accordance with a concomitant feature of the invention, respective slitters for trimming margins of the auxiliary pile support are disposed on opposite sides of the sheet pile.

Other features which are considered as characteristic for the invention are set forth in the appended claims.

Although the invention is illustrated and described herein as embodied in a non-stop pile-change device in a delivery of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
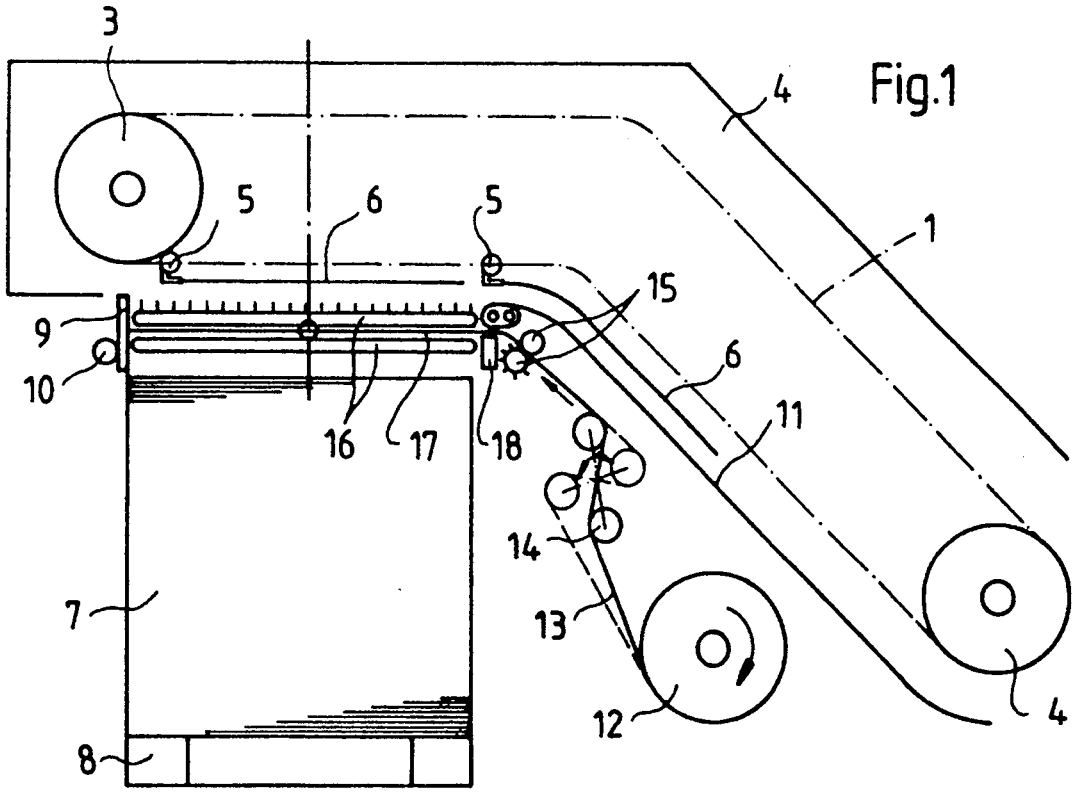
FIG. 1 is a diagrammatic side elevational view of essential elements of a sheet delivery incorporating structural features of an embodiment of the non-stop pile-change device according to the invention.

Referring now to the drawings and, first, particularly to FIGS. i and 2, the two embodiments of the invention are shown incorporated in a sheet delivery formed of a continuously rotating delivery chain 1 revolving on reversing pulleys or sprocket wheels 2 and 3 which are laterally journalled in a frame 4 of the delivery. Sheet grippers 5, which are fastened to gripper bars, grip the sheet 6 at a leading edge thereof and convey it over the sheet pile 7 formed on a main pile support 8. The respective leading edges of the oncoming sheets 6 are released by the sheet grippers 5 and abut against sheet stops 9, if necessary or desirable, under the action of a sheet-braking device which is not illustrated in the figures, and drop onto the sheet pile. Respective lower ends of the sheet stops 9 are attached to a shaft 10 and, for the purpose of pile changing, can be swung out of the vicinity of the sheet pile 7 by appropriate pivoting of the shaft 10.

In the arrangement according to the embodiment of FIG. 1, a paper reel 12 having a maximum format width is provided below sheet guide plates 11. A paper web 13 wound on the paper reel 12 is guided by its leading edge through a web-festooning unit 14 and a paper-advancing or feeding unit 15 between pairwise-arranged clamping jaws 16 which extend laterally adjacent to the sheet pile 7 parallel to the pile surface and are pressable against one another. The festooning device 14, as shown diagrammatically in FIG. 1, is formed of a spool-like device which, when turned in one direction, stores a pre-determined length of the paper web 13, and releases the web length, when turned in the opposite direction. The paper-advancing or feeding unit 15 is formed, for example, of a pair of rollers causing the paper web 13 to be advanced or fed in a manner similar to the transporting movement of photographic film in a film camera. The feeding velocity of the paper web 13 is in synchronism with the transport velocity of the oncoming sheets 6. For a non-stop pile change, a pre-determined length of the paper web 13 is drawn by the paper-advancing or feeding unit 15 from the festooning unit 14 and inserted as an auxiliary pile support 17 between two sheets in transport or conveying direction of the oncoming sheets 6, and is clamped and held fast at both side margins thereof by the clamping jaws 16. A cross cutter 18 separates or severs this auxiliary pile support 17 from the paper web 13 which continues to be held by the paper-advancing or feeding unit 15. The oncoming sheets 6 then accumulate on this auxiliary pile support 17 so that the main pile 7 and its main pile support 8 may be removed in a conventional manner and replaced by a new main pile support 8. At the same time, a new section of the paper web 13 corresponding to the length necessary for an auxiliary pile support 6 is stored in the festooning unit 4 so that the next auxiliary pile support 6 may be drawn from the festooning unit 4 without moving the paper reel 12. The paper reel 12 may be equipped with a sheet-braking device, if necessary or desirable, in order to prevent the paper reel 12 from following thereafter when the festooning unit 14 is activated.

Figure 2:
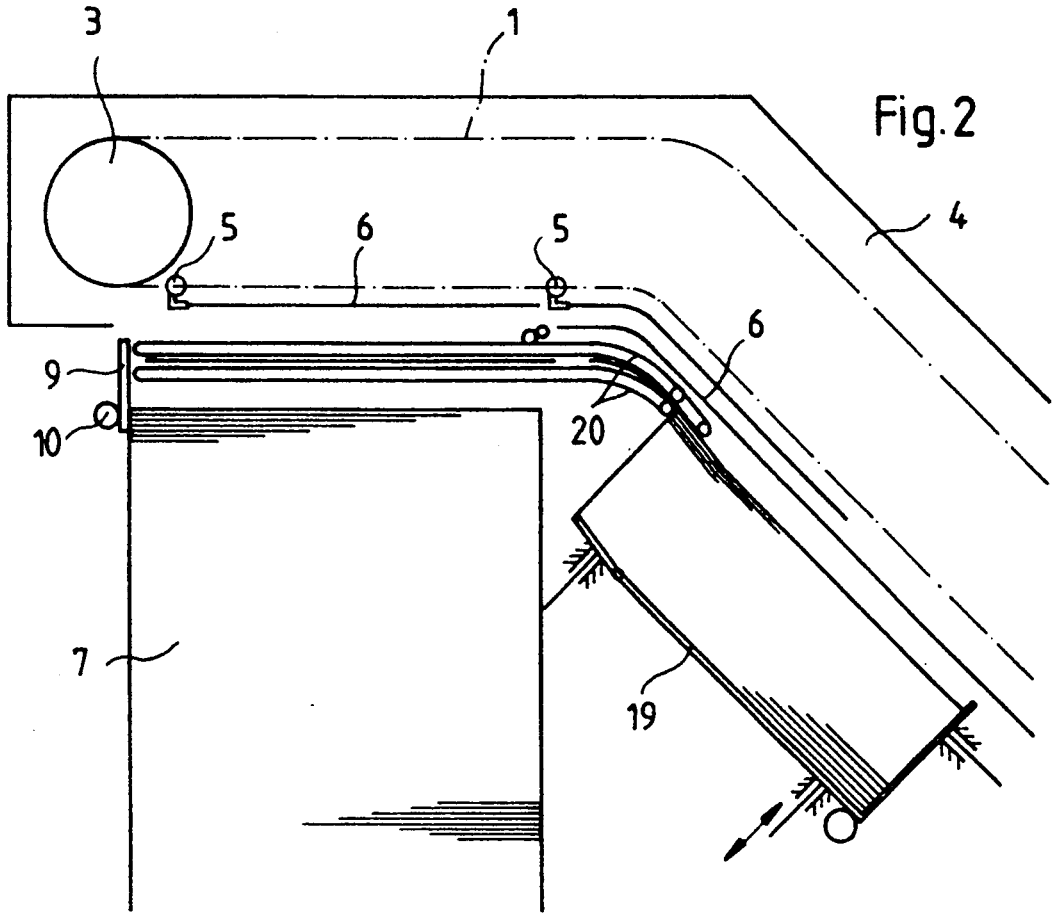
FIG. 2 is a view like that of FIG. 1 of the sheet delivery incorporating features of another embodiment of the device according to the invention.

In the embodiment of the invention shown in FIG. 2, the respective auxiliary pile supports 17 are taken individually from an interchangeable cassette 19 and, for the non-stop pile change, are respectively inserted between two oncoming sheets 6 at the same advancing or feed rate. In this embodiment, the paper-advancing or feeding unit 15 is formed of a pair of clamping tapes 20 which draw the auxiliary pile support 17 from the interchangeable cassette 19 and clamp it therebetween, in the vicinity of the main pile 7, for the purpose of advancing or feeding the paper sheets forming the auxiliary pile supports 17.

Figure 3:
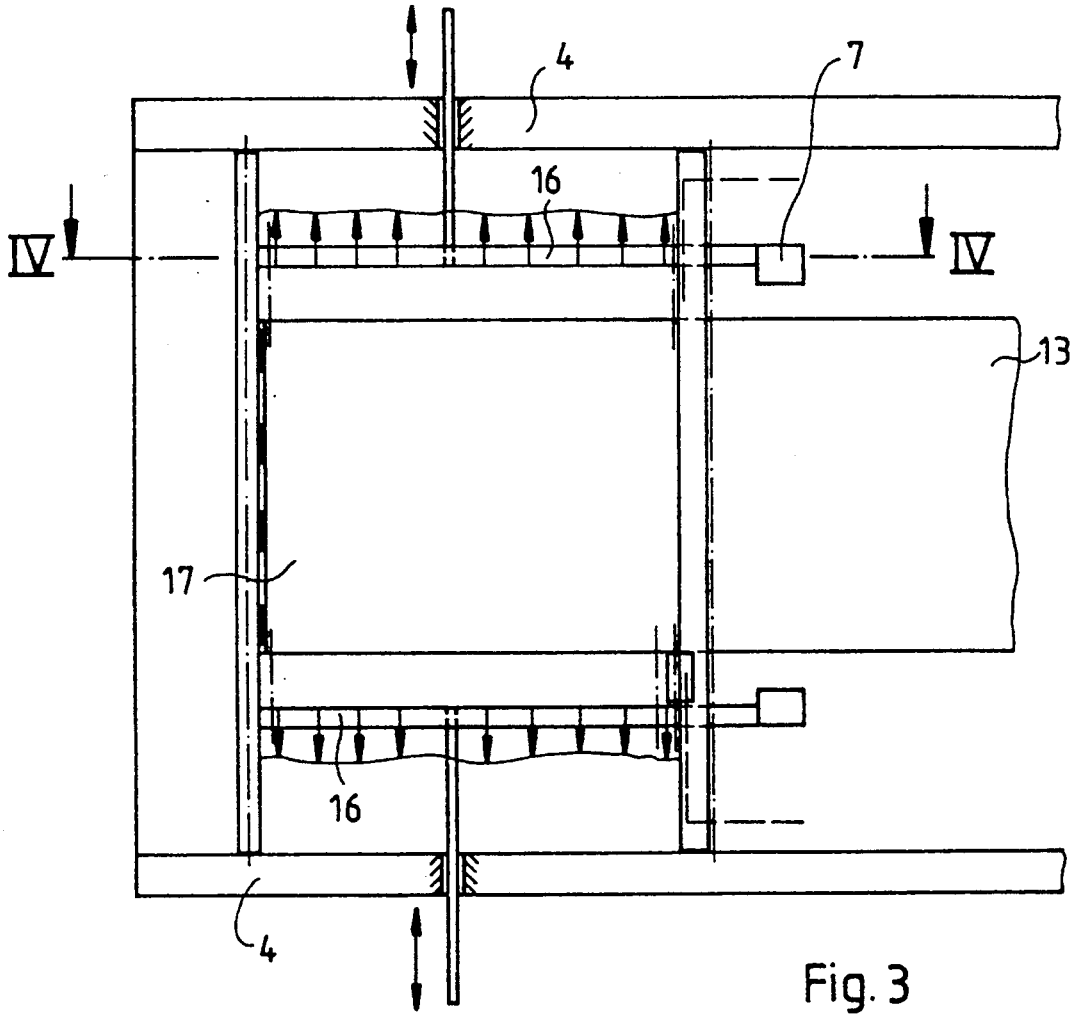
FIG. 3 is a diagrammatic top plan view of FIG. 1.
Figure 4:
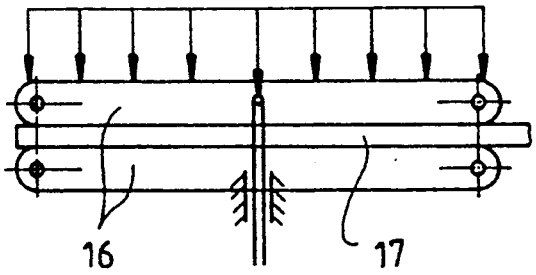
FIG. 4 is a sectional view of FIG. 3 taken along the line IV—IV in the direction of the arrows.

FIGS. 3 and 4 show the adjustable arrangement of the clamping jaws 16. According to FIG. 4, the clamping jaws 16 are movable relative to one another so that the respective edge or margin of the auxiliary pile support 17 is clamped therebetween. Moreover, the clamping jaws 16 are movable outwardly in horizontal direction according to FIG. 3 in order to tighten the clamped auxiliary pile support 17 laterally and to stabilize it sufficiently for receiving an auxiliary pile. This horizontal adjustment of the clamping jaws 16 may be used simultaneously for matching or adapting to the format width, if auxiliary pile supports 17 are used which are to be adapted to the format width of the printed sheets. For this purpose, either the paper reel 12 or the interchangeable cassette 19 is to be exchanged during the format adjustment. Another possibility suggests the use of auxiliary pile supports having a respective width which is adapted or matched to the maximum printing format and, if smaller formats are required or desired, the side margins may be trimmed by means of slitters or the like, as mentioned hereinbefore.

The foregoing is a description corresponding in substance to German Application P 42 21 928.0, dated Jul. 3, 1992, the International priority of which is being claimed for the instant application, and which is hereby made part of this application. Any material discrepancies between the foregoing specification and the aforementioned corresponding German application are to be resolved in favor of the latter.

I claim:

1. Non-stop pile-changing device in a delivery of a printing press, comprising an auxiliary pile support insertable between two sheets in a sheet-conveying direction for temporarily receiving thereon oncoming sheets in an auxiliary pile, means for exchanging a main pile of sheets and an old main pile support whereon the main pile has been deposited for a new main pile support, and means for depositing the auxiliary pile on said new main pile support, said auxiliary pile support being relatively thin in comparison with the thickness of said main pile support, and remaining underneath the auxiliary pile and forming a base for the auxiliary pile as it is being deposited on said new main pile support.

2. Device according to claim 1, wherein said auxiliary pile support is formed of a material selected from the group consisting of paper, cardboard and plastic material.

3. Device according to claim 1, including releasable clamping jaws mounted in the delivery of the printing press for clamping side margins of the inserted auxiliary pile support as the oncoming sheets are deposited in an auxiliary pile thereon.

4. Device according to claim 3, comprising transport means for seizing the auxiliary pile support and feeding it between the two sheets parallel to a surface of the pile.

5. Device according to claim 4, wherein said transport means include a feeding unit comprising pairwise arranged clamping tapes laterally revolvable parallel to sides of the sheets for clamping respective margins of said auxiliary pile support therebetween.

6. Device according to claim 4, wherein said transport means include a feeding unit comprising at least one pneumatic cylinder disposed parallel to the sheet-pile surface and extensible telescopically, an extensible end of said pneumatically extensible cylinder having a sheet gripper secured thereto.

7. Device according to claim 4, wherein said transport means include a feeding unit comprising at least one roller pair having gear rims at least at the ends of one roller of said roller pair.

8. Device according to claim 1, including a web reel having a web wound thereon, means for unwinding said web from said web reel so as to form said auxiliary pile support therefrom, and a cross cutter adjacent said unwinding means for severing a web length corresponding to said auxiliary pile support from the web.

9. Device according to claim 8, including a festooning unit into which the web length corresponding to said auxiliary pile support, prior to being severed from the web wound on the web reel, is guidable for storage therein, said stored web length being releasable for inserting it as said auxiliary pile support between the two sheets, while said web reel remains stationary.

10. Device according to claim 9, wherein said festooning unit is adjustable so that the stored web length corresponds with the length of a respective format.

11. Device according to claim 9, wherein said festooning unit comprises a spool-type device turnable in one direction for receiving thereon the web length of pre-determined dimension, said spool-type device being turnable in the opposite direction for releasing the web length while said web reel remains stationary.

12. Device according to claim 1, including a cassette having a plurality of said auxiliary pile supports stored therein, said auxiliary pile supports having dimensions matching the respective format of the oncoming sheets.

13. Device according to claim 1, wherein respective slitters for trimming margins of said auxiliary pile support are disposed on opposite sides of the sheet pile.

* * * * *